US006148759A

United States Patent [19]

Taylor, Jr.

[11] Patent Number: 6,148,759

[45] Date of Patent: Nov. 21, 2000

[54] REMOTE ROV LAUNCH AND RECOVERY APPARATUS

[75] Inventor: Leland Harris Taylor, Jr., Houston, Tex.

[73] Assignee: J. Ray McDermott, S.A., New Orleans, La.

[21] Appl. No.: 09/256,113

[22] Filed: Feb. 24, 1999

[51] Int. Cl.[7] ..... B63G 8/00

[52] U.S. Cl. ..... 114/312; 114/258

[58] Field of Search ..... 114/312, 313, 114/328, 337, 338, 254, 258, 259; 440/33, 34

[56] References Cited

U.S. PATENT DOCUMENTS

| | | | |
|---|---|---|---|
| 3,550,386 | 12/1970 | Ballinger | 114/337 |
| 3,918,113 | 11/1975 | Talkington | 114/254 |
| 3,955,522 | 5/1976 | Gaudino et al. . | |
| 4,312,287 | 1/1982 | Kuo . | |
| 4,343,098 | 8/1982 | Ballingand et al. . | |
| 4,361,104 | 11/1982 | Lloyd, III et al. . | |
| 4,390,305 | 6/1983 | Sloan . | |
| 4,556,004 | 12/1985 | Lamy et al. . | |
| 5,039,254 | 8/1991 | Piercy | 114/312 |
| 5,046,895 | 9/1991 | Baugh . | |
| 5,378,851 | 1/1995 | Brooke et al. . | |
| 5,752,460 | 5/1998 | Buffman et al. | 114/312 |

OTHER PUBLICATIONS

Jesse Houle and Mae Seto; Aurora—An Active Tow Body For Instrumentation; Sea Technology Apr. 1999; pp. 55–60.

*Primary Examiner*—Jesus D. Sotelo
*Attorney, Agent, or Firm*—Robert J. Edwards; D. Neil LaHaye

[57] ABSTRACT

A remotely operated ROV service vessel. The remotely operated vessel utilizes dynamic positioning. The vessel is remotely controlled by radio telemetry, preferably modular in construction, and may be semi-submersible. The vessel contains a radio telemetry package, one or more generators, an umbilical winch for lowering and raising an ROV, space for receiving and storing an ROV, and ballast control.

2 Claims, 1 Drawing Sheet

REMOTE ROV LAUNCH AND RECOVERY APPARATUS

BACKGROUND OF THE INVENTION

1. Field of the Invention

The invention is generally related to the use of a remotely operated vehicle (ROV) for underwater work and more particularly to means for launching, controlling, and recovering an ROV.

2. General Background

Many underwater operations, such as drilling for and production of oil and gas, installation and maintenance of offshore structures, or laying and maintaining underwater pipelines require the use of a remotely operated vehicle (ROV).

The deployment of an ROV is typically achieved by launching the unit from either a bottom founded or floating host platform or from a dynamically positioned marine vessel dedicated specifically for the purpose of supporting an ROV, e.g. an ROV support vessel (RSV).

Both bottom founded and floating host platforms are fixed in position at the site and are normally engaged in collateral activities such as drilling and offshore production or construction. Thus, the operations of the ROV are limited according to the distance that the ROV can travel from the host platform as well as by restrictions in operating periods due to the collateral activities of the host platform.

In the case of dedicated vessel deployment such as an RSV, significant costs are associated with operation of a fully founded marine vessel and its mobilization to and from the ROV work site. Typically, a dedicated RSV may have a crew of twenty and a considerable cost not directly related to the operation of the ROV.

ROV operation and monitoring is controlled from the host platform or RSV by means of an umbilical line between the host platform or RSV and the ROV. It can be seen from this that the operational distance of the ROV is directly related to the length of the umbilical line.

It can be seen that the present state of the art leaves a need for an apparatus capable of launching, controlling, and recovering an ROV that eliminates the limitations associated with operation from a fixed host platform and reduces the expense associated with a manned, dedicated RSV.

SUMMARY OF THE INVENTION

The invention addresses the above need. What is provided is a remotely operated ROV service vessel. The remotely operated vessel utilizes dynamic positioning. The vessel is remotely controlled by radio telemetry, preferably modular in construction, and may be semi-submersible. The vessel contains a radio telemetry package, one or more generators, an umbilical winch for lowering and raising an ROV, space for receiving and storing an ROV, and ballast control.

BRIEF DESCRIPTION OF THE DRAWINGS

For a further understanding of the nature and objects of the present invention reference should be made to the following description, taken in conjunction with the accompanying drawing in which like parts are given like reference numerals, and wherein.

DETAILED DESCRIPTION OF THE PREFERRED EMBODIMENT

Figure 1:
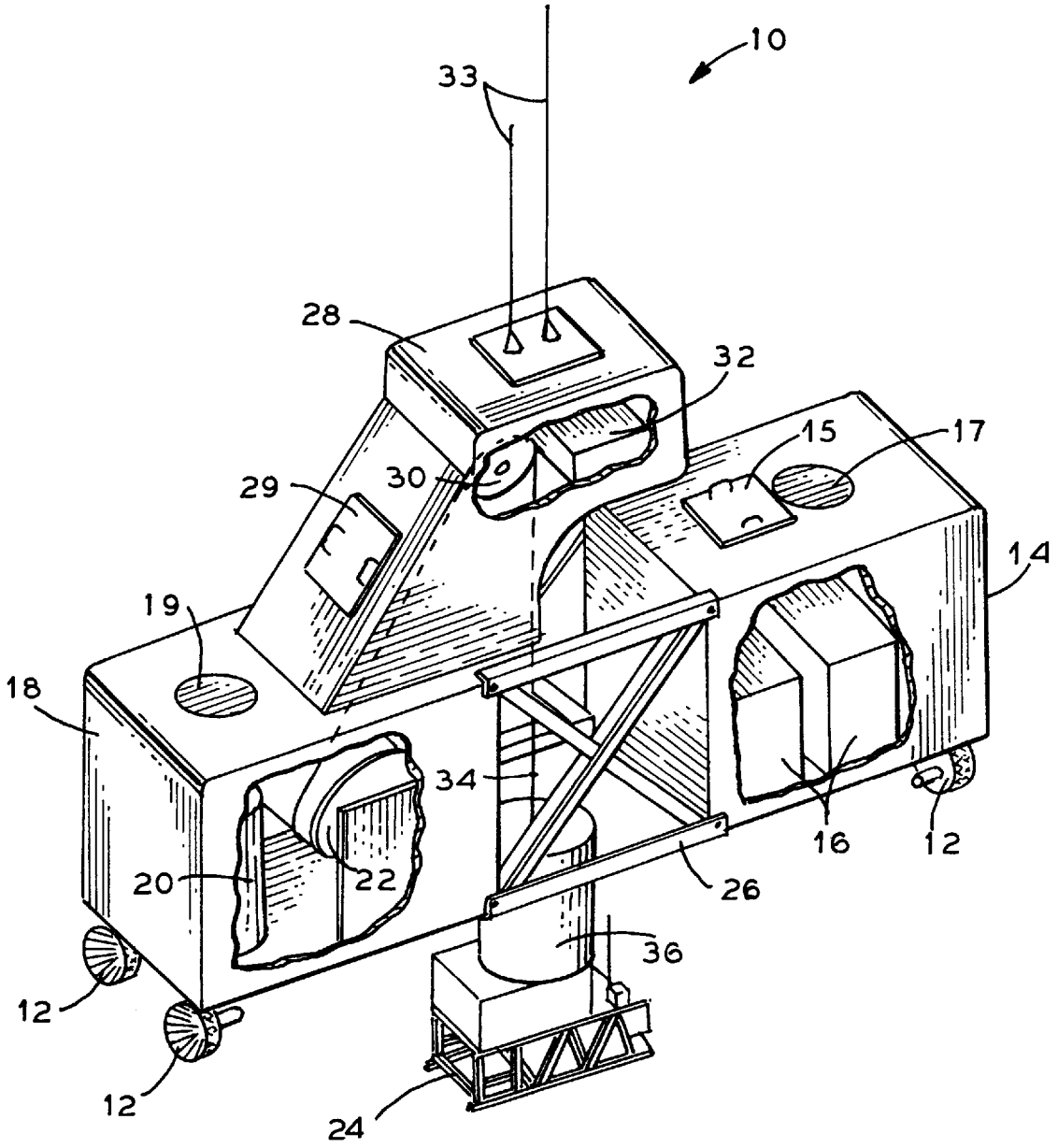
FIG. 1 is a perspective, partial cutaway view of the invention.

Referring to the drawings, it is seen in FIG. 1 that the invention is generally indicated by the numeral 10. Remote ROV service vessel 10 is a buoyant vessel that utilizes a plurality of dynamic positioning thrusters 12, one illustrated at each corner.

Vessel 10 is preferably modular in construction to facilitate trucking, air transport, ease of handling offshore, and exchange of components for ease of maintenance and repair. Each modular component houses one or more vessel subsystems. A typical configuration is described below.

A self-buoyant first module 14 includes one or more generators 16. Generators 16 may be of any suitable type, such as diesel powered electrical generators and are used to power all of the equipment on the vessel 10. Hatch 15 provides for access to the inside of the module for maintenance of the generators 16.

A self-buoyant second module 18 includes ballast control means 20 and umbilical winch 22. Umbilical winches are generally known in the art and contain slip rings not shown to allow communication between the umbilical line revolving on the winch and the ROV surface control package. Any suitable type of ballast control means generally known in the art may be used for controlling the draft of vessel 10 to provide the necessary stability for environmental conditions. Winch 22 is powered by generators 16 and is used to power as well as raise and lower the ROV 24.

First and second modules 14, 18 are rigidly attached together and spaced apart from each other by means of framework 26. The space between the modules is sized to receive the ROV 24.

Third module 28 is attached to the top of the second module 18 and includes a gimbaled and/or heave compensated umbilical sheave 30, radio telemetry equipment 32, and radio telemetry antennas 33. The radio telemetry equipment 32 includes one or more receivers and the necessary controls and connections for providing control inputs to the dynamic positioning thrusters 12, generators 16, ballast control means 20, winch 22, and ROV 24 for all operations. Hatch 29 provides for access to the interior of third module 28 and second module 18 for maintenance of the equipment therein.

Umbilical line 34 is adapted to be attached to a tether management apparatus 36 at the upper end of the ROV 24 and provides for all communication and control inputs to the ROV 24. Umbilical line 34 passes over sheave 30 and down to the winch 22 where a sufficient length of umbilical line is stored for the water depth in which operations are carried out. The umbilical lines and tether management apparatus are generally known in the art, with the tether management apparatus generally being referred to in the industry as a tether management system.

The tether management apparatus 36 is a housing from which a secondary umbilical line not shown is dispensed for directing the ROV after both have been submerged to a suitable depth on the main umbilical line 34. The secondary umbilical line provides for communication and control between the tether management apparatus 36 and the ROV. The main umbilical line 34 is of a more sturdy construction than the secondary umbilical line stored and dispensed by the tether management apparatus 36. The lighter secondary umbilical line allows the ROV to swim more easily at great depths due to less water resistance.

In operation, vessel 10 is transported to a support platform such as a fixed or floating platform or a barge and assembled, if necessary, into the configuration as seen in FIG. 1. ROV 24 is provided with tool attachments for the type of work to be performed and stored in the space between the first and second modules. Pick up points 17, 19, on the first and second modules respectively, are used to have a crane or davit lift the vessel 10 and place it in the water. Any suitable type of pick up attachments generally known in the industry may be used. Trim and stability of the vessel 10 is adjusted by use of the ballast control means 20 via the radio telemetry equipment 32. The crane or davit is detached from the lowering points 17, 19. An operator on the support platform then uses radio telemetry equipment to cause the vessel 10 to travel, semisubmerged, to the ROV mission location using the dynamic thrusters 12, which are powered by the generators 16. The operator then uses the radio telemetry equipment to cause the winch 22 to unwind umbilical line 34 and direct the tether management apparatus 36 and ROV 24 to the operating depth. As the ROV is launched and main umbilical line 34 dispensed, the trim and stability of the vessel 10 is adjusted as necessary using the ballast control means 20. At the operating depth, the ROV 24 swims clear of the tether management apparatus 36 using the secondary umbilical line. The ROV is still controlled using the radio telemetry equipment 32. While the ROV performs the mission tasks, the vessel 10 maintains its position relative to the tether management apparatus 36 to insure the optimum main umbilical configuration using the dynamic thrusters 12. Once the ROV mission is complete, the reverse of the above operations takes place to recover the ROV to the vessel and return the vessel to the host facility where it is recovered from the water.

Although the components are described above as being installed in a specific module, it should be understood that this is for descriptive purposes only and that any suitable arrangement may be utilized.

The invention provides a number of advantages over the present state of the art. The invention allows deployment and use of an ROV where a dedicated ROV support vessel is not readily available. The invention allows offshore facilities such as platforms, drill rigs, and floating production systems such as TLP's, FPSO's, and Spars to be self-sustaining in terms of subsea inspection and intervention, thus allowing rapid response to system failure or incidents involving subsea infrastructure. This also reduces the costs associated with retaining an ROV at the ready since the dedicated ROV service vessel and crew are not required. The invention also reduces the weather and sea state sensitivity to ROV launch and recovery operations. This is because operations can be accomplished from a bottom founded support platform, a floating support platform such as a floating structure moored in place, or a barge that is much larger than a dedicated ROV support vessel. Because the invention is modular, it can be mobilized by all means of transportation, e.g. rail, road, or air. This allows for the rapid deployment of an ROV where ships or boats are not immediately available or cost effective. This allows the invention to find use in search and recovery missions, seabed mineral exploration and oceanographic surveys where a multitude of units could be deployed from a single host vessel to thereby allow a maximum of seabed coverage with a minimum of manned vessel involvement.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A remotely operated ROV service vessel, comprising:

a. a first self-buoyant module;

b. electrical generating means housed in said first module;

c. a second self-buoyant module attached to and spaced apart from said first module;

d. an umbilical winch housed in said second module, said winch having an umbilical line adapted for attachment to and providing control inputs to an ROV;

e. dynamic positioning thrusters provided on said first and second modules;

f. a third module attached to the upper end of said second module;

g. radio telemetry equipment housed in said third module adapted to receive radio signals and to provide control inputs to said generators, winch, dynamic positioning thrusters, and to an ROV attached to the umbilical line.

2. The vessel of claim 1, further comprising ballast control means housed in said second module.

* * * * *